US010508857B2

(12) United States Patent
Emek et al.

(10) Patent No.: US 10,508,857 B2
(45) Date of Patent: Dec. 17, 2019

(54) HOME APPLIANCE DEVICE

(71) Applicant: BSH-HAUSGERAETE GMBH, Munich (DE)

(72) Inventors: Emre Emek, Istanbul (TR); Emre Guentav, Istanbul (TR); Rasit Oenver, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 19 days.

(21) Appl. No.: 15/364,490

(22) Filed: Nov. 30, 2016

(65) Prior Publication Data

US 2018/0149411 A1 May 31, 2018

(51) Int. Cl.

*F25D 23/06* (2006.01)
*A47B 96/02* (2006.01)
*F25D 25/02* (2006.01)

(52) U.S. Cl.

CPC ..... *F25D 23/066* (2013.01); *A47B 96/027* (2013.01); *F25D 23/063* (2013.01); *F25D 23/067* (2013.01); *F25D 25/02* (2013.01); *F25D 2400/18* (2013.01)

(58) Field of Classification Search

CPC ..... F25D 25/02; F25D 11/00; F25D 2400/06; F25D 23/066; F25D 23/067; F25D 23/069; F25D 23/06; F25D 23/062; F25D 23/063; F25D 23/065; F25D 2325/021; F25D 2400/18; A47B 96/027; A47B 96/1458; A47B 57/52; A47B 96/02; A47B 57/42; A47B 57/425; A47B 57/32; A47B 57/34

USPC ..... 312/408; 108/108

See application file for complete search history.

(56) References Cited

U.S. PATENT DOCUMENTS 3,162,416 A * 12/1964 Amarillas ..... A47B 57/34 248/244
3,917,206 A * 11/1975 Fisher ..... F25D 23/067 248/239
4,043,624 A * 8/1977 Lindenschmidt ..... F25D 23/062 220/592.05
4,067,628 A * 1/1978 Sherburn ..... F25D 23/064 220/592.05
4,180,297 A * 12/1979 Abrams ..... F25D 23/065 16/2.2
4,195,888 A * 4/1980 Squire ..... F25D 23/067 248/235

(Continued)

FOREIGN PATENT DOCUMENTS

DE 202004017125 U1 3/2006
JP 2002195742 A 7/2002

(Continued)

*Primary Examiner* — Hiwot E Tefera

(74) *Attorney, Agent, or Firm* — Laurence A. Greenberg; Werner H. Stemer; Ralph E. Locher

(57) ABSTRACT

For the purpose of improving manufacturability, a home appliance device, in particular a home chiller appliance device, is proposed. The device has at least one inner liner defining at least one storage space and having at least one first wall section and at least one second wall section with at least one gap between the first wall section and the second wall section. A separate cover unit is connected to the inner liner and is arranged outside the storage space. The cover unit covers the gap.

15 Claims, 5 Drawing Sheets

(56) References Cited

U.S. PATENT DOCUMENTS 4,715,512 A * 12/1987 Buchser ..... F25D 23/064 220/592.1
5,185,971 A * 2/1993 Johnson, Jr. ..... A47B 57/408 211/94.01
5,199,778 A * 4/1993 Aoki ..... A47B 57/32 108/147
5,692,817 A * 12/1997 Jun ..... A47B 46/00 211/151
6,112,542 A * 9/2000 Lee ..... F25D 17/065 62/407
7,669,945 B2 * 3/2010 Blersch ..... F25D 23/067 108/107
8,240,791 B2 * 8/2012 Benz ..... A47B 96/027 211/153
8,651,600 B2 * 2/2014 Cheong ..... F25D 23/00 312/408
9,010,564 B2 * 4/2015 Jessie ..... F25D 23/082 220/592.02
9,644,885 B1 * 5/2017 Johnson ..... F25D 25/02
10,126,042 B2 * 11/2018 Cetinyol ..... F25D 23/066
2004/0263038 A1 * 12/2004 Ribolzi ..... F25D 23/067 312/408
2006/0163985 A1 * 7/2006 Blersch ..... F25D 23/067 312/408
2006/0223351 A1 * 10/2006 Kim ..... F25D 23/064 439/157
2008/0030114 A1 * 2/2008 Becke ..... A47B 57/425 312/408
2009/0302726 A1 * 12/2009 Eckartsberg ..... A47B 57/425 312/312
2010/0031694 A1 * 2/2010 Benz ..... A47B 96/027 62/465
2010/0164342 A1 * 7/2010 Hagele ..... A47B 57/425 312/408
2013/0160483 A1 * 6/2013 Hasturk ..... F25D 11/00 62/452
2013/0249361 A1 * 9/2013 Kendall ..... F25D 17/062 312/237
2013/0277323 A1 * 10/2013 Cheong ..... F25D 23/00 211/119.003
2016/0278519 A1 * 9/2016 Seeley ..... F25D 25/024
2016/0290711 A1 * 10/2016 Brown ..... F25D 25/02
2017/0191742 A1 * 7/2017 Lim ..... A47B 88/407
2017/0219272 A1 8/2017 Cetinyol et al.

FOREIGN PATENT DOCUMENTS

WO 2006120097 A1 11/2006
WO 2016016416 A1 2/2016

* cited by examiner

HOME APPLIANCE DEVICE

BACKGROUND OF THE INVENTION

Field of the Invention

The invention relates to a home appliance device, in particular a home chiller appliance device.

From the prior art refrigerators are known featuring rails for supporting shelves and other insert elements. These rails are arranged inside an inner liner, for instance on a rear wall of the inner liner.

SUMMARY OF THE INVENTION

An objective of the invention is, in particular, to provide a generic home appliance device with improved characteristics regarding manufacturing. This objective is achieved, according to the claimed invention. Advantageous implementations and further developments of the invention may be gathered from the dependent claims.

A home appliance device, in particular a home chiller appliance device, is proposed, comprising: at least one inner liner defining at least one storage space and having at least one first wall section and at least one second wall section with at least one gap between the first wall section and the second wall section; and a separate cover unit which is connected to the inner liner and is arranged outside the storage space, said cover unit covering the gap.

By means of the invention, in particular an improved manufacturability can be achieved. Fast and/or cheap and/or easy assembly of a home appliance device is facilitated. Furthermore, leakage of foam into an inner liner during foaming can be avoided. In addition, a diversity of parts can be reduced. Advantageously, a high stability and/or durability of a home appliance, in particular of a rail system of a home appliance, can be achieved. In addition, visibility of mounting parts for a user can be minimized.

By a "home appliance device" is in particular to be understood at least a portion, in particular a sub-assembly group, of a home appliance. The home appliance is in particular provided for storing and preferably tempering victuals such as beverages, meat, fish, vegetables, fruits, milk and/or dairy products in at least one operating state, advantageously for the purpose of enhancing a storage life of the stored victuals. In particular, the home appliance is embodied as a home chiller appliance, which is in at least one operating state configured for cooling victuals. The home chiller appliance could in particular be embodied as a climate cabinet, an ice-box, a refrigerator, a freezer, a refrigerator-freezer combination and/or a wine cooler. However, the home appliance could also be embodied as a home appliance for warming and in particular for cooking victuals, e.g., an oven, a steamer and/or a microwave. In this context, "configured" is in particular to mean specifically programmed, designed and/or equipped. By an object being configured for a certain function is in particular to be understood that the object implements and/or fulfills said certain function in at least one application state and/or operating state.

The home appliance device may comprise at least one outer liner. In particular, the inner liner may be arranged inside the outer liner. In particular, there may be a gap between the inner liner and the outer liner, which may in particular filled with foam, for instance with Polyurethane foam. During assembly, the inner liner may advantageously be placed inside the outer liner and the gap may subsequently be filled with foam during foaming. In particular, the inner liner and the outer liner together may form a main housing of the home appliance device.

In particular, the first wall section and the second wall section may be implemented separately. However, it is also conceivable that the first wall section and the second wall section may at least partly be implemented integrally. In particular, the first wall section and/or the second wall section may be a wall element of the inner liner defining at least one side wall of the inner liner. In particular, the first wall section may be a rear side wall section and/or the second wall section may be a lateral side wall section. In particular, the second wall section may implement and/or may define at least one edge of the inner liner, in particular a rear side lateral edge. However, it is also conceivable that the first wall section and the second wall section together may implement and/or may define at least one edge of the inner liner, in particular a rear side lateral edge. Furthermore, it is conceivable that the gap may be located at at least one edge of the inner liner, in particular at a rear side lateral edge. In this context, the term "a first object and a second object being at least partly implemented integrally" is in particular to mean that at least one component of the first object and at least one component of the second object are implemented integrally with each other. "Implemented integrally" is in particular to mean, in this context, connected at least by substance-to-substance bond, e.g., by a welding process, an adhesive bonding, an injection-molding process and/or by another process that is deemed expedient by a person having ordinary skill in the art. In particular, "implemented integrally" could in particular mean made of one piece. "Made of one piece" is, in particular, to mean, in this context, manufactured from one single piece, e.g., by production from one single cast and/or by manufacturing in a one-component or multi-component injection-molding process, and for example from a single blank.

The gap may be arranged at a rear side of the inner liner. Additionally or alternatively it is conceivable that the gap may be arranged at a lateral side of the inner liner. In particular, the gap may have at least one gap longitudinal axis, which may be oriented at least substantially parallel or parallel to a height axis of the inner liner and/or to at least one vertical edge of the inner liner. In particular, the gap longitudinal axis may be oriented parallel to a main extension direction of the gap. In this context, "vertical" is in particular to mean perpendicular to a floor on which the home appliance device stands in at least one normal operating condition. In a similar way, terms like "top", "bottom", "lateral", "rear", "front" are in particular to mean with reference to the normal operating condition. In particular, the first wall section and the second wall section may delimit the gap. In particular, the gap may have an at least substantially constant width, in particular a constant width. In particular, the gap may have a width of at least 1 cm or of at least 2 cm or of at least 3 cm or of at least 5 cm and/or a width of no more than 15 cm or no more than 10 cm or of no more than 8 cm or of no more than 6 cm. In this context "at least substantially parallel" is in particular to be understood as an orientation of a direction with respect to a reference direction, in particular in a plane, wherein the direction has a deviation from the reference direction in particular of less than 15°, advantageously of less than 10° and particularly advantageously of less than 2°. A "main extension direction" of an object is, in particular, to be understood, in this context, as a direction extending in parallel to a largest side of an imaginary rectangular cuboid which only just entirely encloses the object. In this context, an "at least substantially constant value" is to be understood as a value that varies by no more than 20%, preferably by no more than 10% and advantageously by no more than 5%.

In particular, the cover unit may define at least one pocket recess, which may be arranged behind the gap when viewed from a front side of the inner liner. In particular, the storage space may at least partly extend into the pocket recess. In particular, the pocket recess may be u-shaped, in particular if viewed from a top side of the inner liner. In particular, the inner liner and the cover unit together may implement a rear side wall, which in particular may delimit the gap between the inner liner and the outer liner. In particular, the cover unit may be arranged inside the outer liner.

For the purpose of providing high usage comfort it is proposed that the first wall section and the second wall section together may form at least one guiding unit, which may delimit the gap and may be configured for insertion of at least one storage unit support element. In this context the storage unit may feature at least one shelf element and/or at least one drawer and/or at least one bottle holder and/or at least one box and/or at least one grating. In particular, the storage unit support element may be configured for holding the storage unit in position with respect to the inner liner. For instance, the storage unit support element may be implemented as a latching element and/or as a hook element and/or as a pin element and/or as a bolt element. In particular, the guiding unit may feature at least two opposing guiding elements for the storage unit support element. In particular, the guiding unit may be configured for guiding the storage unit support element during height adjustment of the storage unit. In particular, the guiding unit may define at least one guiding path for the storage unit support element which may extend at least substantially parallel or parallel to the height axis of the inner liner. In this context, "configured" is in particular to mean specifically programmed, designed and/or equipped. It is conceivable that the home appliance device comprises at least one storage unit. In particular, the home appliance device may comprise a plurality of identical and/or different storage units. By an object being configured for a certain function is in particular to be understood that the object implements and/or fulfills said certain function in at least one application state and/or operating state.

High tightness against foam can be achieved if the cover unit may comprise at least one cover element which may have at least one cover element longitudinal axis oriented at least substantially parallel or parallel to the gap longitudinal axis. In particular, a length of the cover element along the cover element longitudinal axis may at least substantially be equal to a length of the gap along the gap longitudinal axis. In particular, the cover element may be made of metal or plastic, e.g. injection molded. In particular, the cover element may have a stepped contour when viewed along the cover element longitudinal axis. In particular, the cover element may have a constant cross section. In particular, the cover element may feature at least one extruded element. In particular, the cover unit may be connected to the guiding unit. In particular, the cover unit may be slid over the guiding unit. In this context, by the term "at least substantially" is to be understood that a deviation of a first value from a second value is in particular less than 25%, preferably less than 10% and advantageously less than 5% of the second value.

Easy and/or stable mounting of storage units in a storage space and/or easy assembly of an inner liner can be facilitated if the cover element may comprise at least one supporting element for supporting a storage unit support element. In particular, the supporting element may be implemented as a rail element. In particular, the supporting element may be plate-shaped. In particular, the supporting element may feature at least one, in particular a plurality of, fixing elements, in particular fixing openings and/or fixing recesses, for fixing the support element to the supporting element, in particular in different positions. The supporting element may in particular implement a height adjustability for storage units. In particular, the cover element may feature a covering element covering the supporting element, wherein the covering element and the supporting element may be arranged parallel to each other. In particular, the supporting element may be arranged inside the covering element. In particular, the supporting element may be slid in the covering element. In particular, the supporting element and the covering element may be implemented separately. However, it is conceivable that the supporting element and the covering element may be at least partly implemented integrally. In particular, it is conceivable that the cover unit may be implemented integrally.

It is further proposed that the cover unit may comprise at least one cap element which may at least partly cover at least one axial end portion of the cover element. In particular, the cap element may be made of plastic, in particular injection molded. In particular, the cap element may be connected to the cover element, in particular to the covering element of the cover element, in particular via at least one form-fit connection. In particular, the cap element may be configured to be mounted to the cover element in a mounting direction that is perpendicular to the cover element longitudinal axis and/or from outside the storage space towards the storage space. As a result, a storage space is effectively sealed against foam during a foaming.

Easy assembly of an interior of a home appliance can be facilitated if the cap element may cover the cover element on at least one rear side which faces away from the storage space. In particular, the cap element may extend around the rear side of the cover element. In particular, the cap element may engage around the cover element, in particular around the covering element of the cover element. In particular, the cover element may cover at least a portion of the first wall section and/or of the second wall section, in particular a portion adjacent to the cover element. Additionally or alternatively it is conceivable that the cap element may at least partly cover the axial end portion of the cover element on at least one end face, which is oriented at least substantially perpendicularly to the cover element longitudinal axis. In particular, in absence of the cap element, the cover element may be open at the end face.

Diversity of parts can be reduced if the cap element may be implemented mirror-symmetrically, in particular with respect to a symmetry plane which is oriented parallel to the cover element longitudinal axis. In particular, the cover unit and/or the cover element and/or the covering element and/or the supporting element may be implemented mirror-symmetrically, in particular with respect to the symmetry plane which is oriented parallel to the cover element longitudinal axis.

In particular, the cap element may seal the axial end portion of the cover element against foam during foaming. As a result, an interior of an inner liner is protected from foam during foaming.

In a further embodiment of the invention it is proposed that the cap element may feature at least one latching element for latching to the inner liner, in particular to the guiding unit. In particular, the latching element may at least partly be macroscopically deformable. In particular, the latching element may fixe the cap element in a direction away from the storage space. During assembly, the cap element may be slid over the cover unit in a direction towards the storage space and the latching element may be latched to the inner liner. In this context, a "macroscopically deformable object" is, in particular, an object having at least one extension in at least one direction, which extension can be, in particular temporarily and/or without damage, altered by at least 1%, preferably by at least 5%, further preferably by at least 20% and advantageously by at least 50% when a force is applied to the object that is no greater than 100 kN $mm^{-2}$, preferably no greater than 10 kN $mm^{-2}$ and advantageously no greater than 1 kN $mm^{-2}$. As a result, a cap element can be mounted to an inner liner tightly and easily.

For the purpose of providing a stable connection of a cap element to an inner liner, it is proposed that the latching element may protrude at least partly through the gap into the storage space. In particular, the latching element may at least partly be located in the recess. It is further conceivable that the latching element may be located at least partly in the storage space and outside the pocket recess.

Furthermore, it is proposed that the inner liner may comprise at least one seam arranged below the gap. In addition, it is proposed that the cap element may features at least one seam cover element which may partly engage around at least one axial end portion of the seam. In particular, the seam cover element may be u-shaped. In particular, the first wall section and the second wall section may together implement the seam. In particular, the first wall section and the second wall section may be connected via the seam. In particular, the seam may comprise a first seam wall element and a second seam wall element which may contact each other, wherein in particular the first wall section implements the first seam wall element and/or the second wall section implements the second seam wall element. In particular, the seam may have a longitudinal axis which is oriented at least substantially parallel or parallel to a gap longitudinal axis. In particular, the seam may be arranged adjacently to the gap, in particular along the gap longitudinal axis. In particular, the first wall section and the second wall section may be bent, in particular at at least one of their edges, in order to form the seam. As a result, a tight connection between wall elements next to an access gap can be achieved.

The possibility of using one type of cap element for capping different elements of a home appliance can be created if the cap element may feature at least one additional seam cover element, which may be implemented mirror-symmetrically to the seam cover element. In particular, the seam cover element and the additional seam cover element are arranged neighboring to each other. In an assembled state of the home appliance device only one the at least two seam cover elements may cover a seam. The other seam cover element—in case there are more than two seam cover elements: the other seam cover elements—may not cover a seam. These other seam cover element(s) may allow the very same cap element to be used in a different home appliance device and/or to be used in a different location within the very same type of home appliance device.

In particular, the cover unit may comprise at least one additional cap element covering at least one additional axial end portion of the cover element, which additional axial end portion may be arranged opposite the axial end portion. It is conceivable that the additional cap element may be embodied identically to the cap element. Alternatively, the additional cap element may be similar to the cap element. In particular, the additional cap element implements an analogous function to the cap element.

In particular, the home appliance device may comprise at least one second cover unit, covering at least one second gap. In particular, the second cover unit may feature at least one second cover element and at least one second cap element. In particular, the second gap may be implemented analogously to the gap and/or the second cover unit may be implemented analogously to the cover unit. In particular, the second cover unit may be arranged opposite the cover unit. For instance, the cover unit and the second cover unit may be arranged on opposite sides of a rear side of the inner liner, implementing two opposite support rails for storage units.

High durability can be achieved if the first wall section and/or the second wall section is made of metal. In particular, the inner liner is made of metal. In particular, the first wall section and/or the second wall section may be implemented as bent sheet metal elements.

However, it is also conceivable that the inner liner is at least partly or completely made of plastic. It is further conceivable that the first wall section and/or the second wall section may be made of plastic.

Easy and/or cheap and/or reliable manufacturability is promoted by a home appliance, in particular a home chiller appliance, comprising at least one home appliance device according to the invention.

Herein the home appliance device is not to be limited to the application and implementation described above. In particular, for the purpose of fulfilling a functionality herein described, the home appliance device may comprise a number of respective elements, structural components and units that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing an exemplary embodiment of the invention is shown. The drawing, the description and the claims contain a plurality of features in combination. The person having ordinary skill in the art will purposefully also consider the features separately and will find further expedient combinations.

If there is more than one specimen of a certain object, only one of these is given a reference numeral in the figures and in the description. The description of this specimen may be correspondingly transferred to the other specimens of the object.

DETAILED DESCRIPTION OF THE INVENTION

Figure 1:
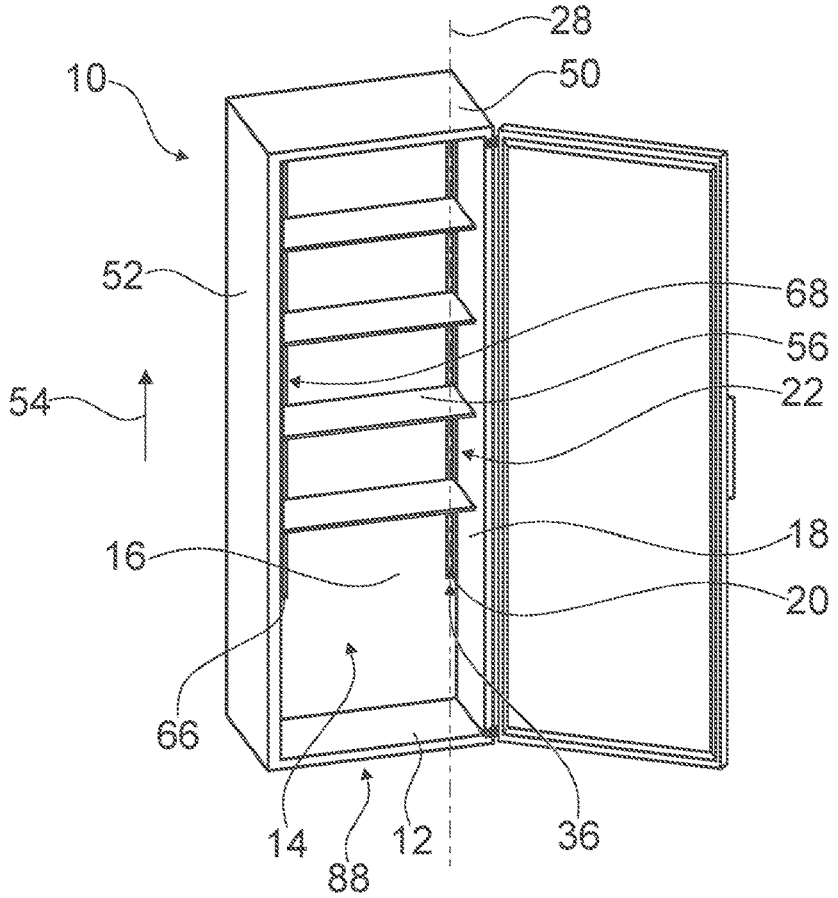
FIG. 1 a home appliance comprising a home appliance device, in a perspective view, FIG. 2 a portion of the home appliance device including a portion of a cover unit of the home appliance device, in a perspective view, FIG. 3 a portion of the home appliance device including a cap element of the cover unit in a pre-mounted state, in a perspective view, FIG. 4 a portion of the home appliance device, in a perspective sectional view along a section plane IV of FIG. 2, FIG. 5 a portion of the home appliance device including the cap element in a pre-mounted state, in a sectional view along the section plane IV of FIG. 2, FIG. 6 the portion of the home appliance device including the cap element in a mounted state, in a sectional view along the section plane IV of FIG. 2, FIG. 7 a portion of the home appliance device including an additional cap element of the cover unit in a pre-mounted state, in a perspective view, FIG. 8 a portion of the home appliance device including the additional cap element in a pre-mounted state, in a sectional lateral view, FIG. 9 the portion of the home appliance device including the additional cap element in a mounted state, in a sectional lateral view, and FIG. 10 a portion of the home appliance device including the additional cap element, in a sectional top view along a section line X-X of FIG. 9.

FIG. 1 shows a home appliance 50 comprising a home appliance device 10 in a perspective view. The home appliance 50 is a home chiller appliance. In the case shown the home appliance 50 is a refrigerator. However, other home appliances are conceivable as mentioned above. The home appliance device 10 is a home chiller appliance device.

The home appliance device 10 comprises an inner liner 12, which defines a storage space 14. The inner liner 12 comprises a first wall section 16 and a second wall section 18 with at least one gap 20 between the first wall section 16 and the second wall section 18. The home appliance device 10 comprises a separate cover unit 22 which is connected to the inner liner 12 and is arranged outside the storage space 14. The cover unit 22 covers the gap 20.

The gap 20 is accessible from the storage space 14. The gap 20 has a gap longitudinal axis 30 which is oriented parallel to a height direction 54 of the home appliance device 10. The first wall section 16 is made of metal. The second wall section 18 is made of metal. The first wall section 16 and the second wall section 18 are implemented as bent sheet metal elements. The cover unit 22 implements a pocket recess which is part of the storage space 14 and accessible through the gap 20.

The home appliance device 10 comprises an outer liner 52. The cover unit 22 is arranged in a gap between the inner liner 12 and the outer liner 22, which gap is not shown in the figures. The gap between the inner liner 12 and the outer liner 22 is filled with polyurethane foam. The inner liner 12 is arranged within the outer liner 52. The cover unit 22 is arranged inside the outer liner 52.

Figure 2:
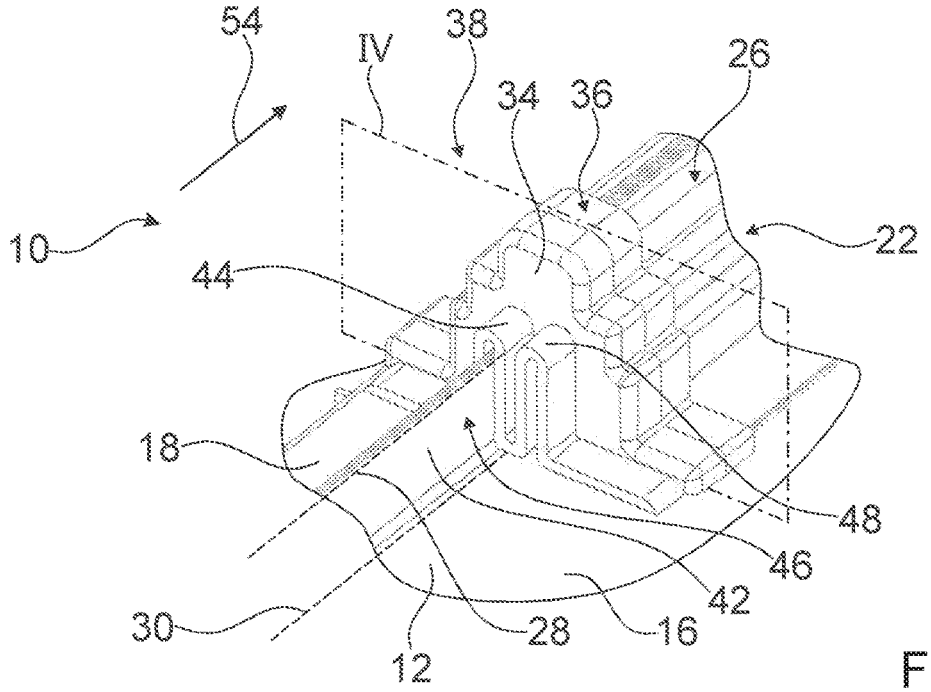

FIG. 2 shows a portion of the home appliance device 10 including a portion of the cover unit 22, in a perspective view. The cover unit 22 comprises a cover element 26 which has at least one cover element longitudinal axis 28, which is oriented at least substantially parallel to the gap longitudinal axis 30 of the gap 20.

The cover unit 22 comprises a cap element 34 which at least partly covers an axial end portion 36 of the cover element 26. The axial end portion 36 is a bottom axial end portion of the cover element 26. The axial end portion 36 of the cover element 26 is open towards a bottom side 88 of the inner liner 10.

The cap element 34 covers the cover element 26 on a rear side 38 which faces away from the storage space 14. The cap element 34 is connected to the cover element 26 via a form-fit connection. A contour of the cap element 34 is adapted to a contour of the cover element 26. The cover element 26 has a stepped contour. The cap element 34 has a stepped contour.

Figure 3:
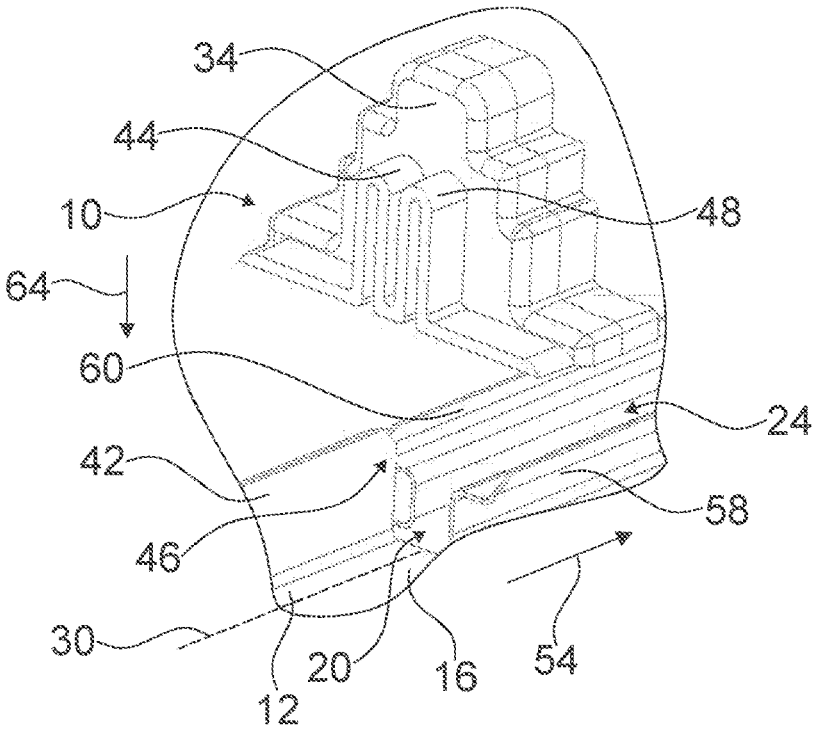
Figure 4:
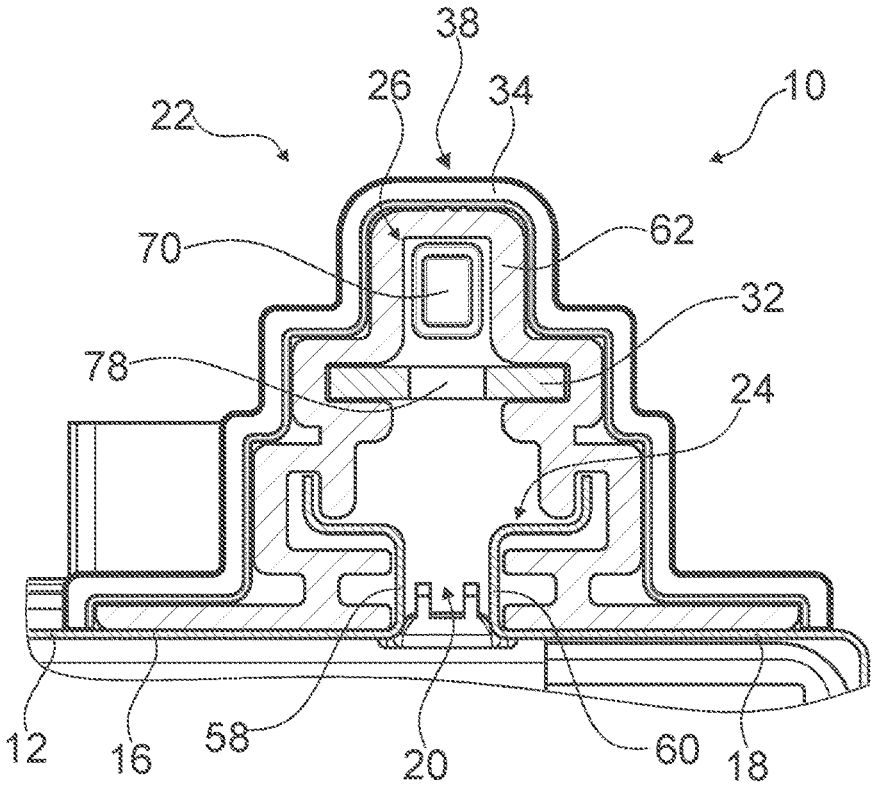

FIG. 3 shows a portion of the home appliance device 10 including a cap element 34 of the cover unit 22 in a pre-mounted state, in a perspective view. For reasons of clarity the cover element 26 is not shown in FIG. 3. FIG. 4 shows a portion of the home appliance device 10, in a perspective sectional view along a section plane IV of FIG. 2.

The first wall section 16 and the second wall section 18 together form at least one guiding unit 24 which delimits the gap 20. The guiding unit 24 is configured for insertion of at least one storage unit support element. Such a storage unit may for instance be a shelf element 56 of the home appliance 50 (compare FIG. 1). As mentioned above it is also conceivable that a storage unit features a drawer and/or a box and/or a bottle holder or the like. In the case shown the guiding unit 24 is configured for insertion of hook-shaped storage unit support elements. The guiding unit 24 is configured for guiding storage unit support elements during a height adjustment of a storage unit.

The guiding unit 24 features a first guiding element 58 which is implemented by the first wall section 16. The guiding unit 24 features a second guiding element 60 which is implemented by the second wall section 18. The first guiding element 58 and the second guiding element 60 delimit the gap 20.

The cover element 26 comprises a supporting element 32 for supporting a storage unit support element. The supporting element 32 is implemented as a metal rail. The supporting element 32 implements a support rail for storage units. The supporting element 32 features a plurality of openings 78 along its main extension direction, only one of which openings 78 is visible in FIG. 4. The supporting element 32 extends along the height direction 54. A length of the supporting element 32 equals a length of the gap 20. The openings 78 define different height positions for storage units.

The cover element 26 comprises a covering element 62 which covers the support element. The covering element 62 is made of metal. The supporting element 32 is slid in the covering element 62 in a direction that is parallel to the height direction 54.

The cover element 26 is connected to the guiding unit 24. The guiding unit 24 implements an inner rail for the cover element 26. The covering element 62 is connected to the guiding unit 24. The cover element 26 is slid over the guiding unit 24 in a direction that is parallel to the height direction 54.

The cap element 34 seals the axial end portion 36 of the cover element 26 during foaming. The cap element 34 prevents foam from flowing into the storage space 14 through the gap 20 during foaming.

The cap element 34 is interlocked with the cover element 26, in particular with the covering element 62. The cap element 34 features a protrusion 70 which is interlocked with the cover element 26.

The cap element 34 is implemented mirror-symmetrically. The cap element 34 is implemented mirror-symmetrically with respect to a symmetry plane which is oriented parallel to the gap longitudinal axis 30.

The inner liner 12 comprises a seam 42 arranged below the gap 20. The first wall section 16 and the second wall section 18 implement the seam 42. The first wall section 16 and the second wall section 18 are connected at the seam 42. The seam 42 is offset from the guiding unit 24 in a direction that is parallel to the height direction 54 by a few millimeters. The seam 42 is offset from the gap longitudinal axis 30 in a direction that is perpendicular to the height direction 54 and perpendicular to a mounting direction 64.

The cap element 34 features a seam cover element 44 which partly engages around an axial end portion 46 of the seam 42. The seam cover element 44 is configured for providing positioning guidance during mounting of the cap element 34 to the inner liner 12 and to the cover element 26. During mounting of the cap element 34 to the inner liner 12 and to the cover element 26, the seam cover element 44 is slid over the seam 42 in a mounting direction 64 which is oriented perpendicularly to the height direction 54.

The cap element 34 features an additional seam cover element 48 which is implemented mirror-symmetrically to the seam cover element 44. The additional seam cover element 48 allows mounting to wall sections that are implemented in a back-to-front manner with respect to the first wall section 16 and the second wall section 18. In the case shown the home appliance device 10 comprises a second gap 66 and a second cover unit 68. The second cover unit 68 is arranged opposite the cover unit 22 and implements a second support rail for storage units. The second cover unit 68 is implemented mirror-symmetrically to the cover unit 26. The second cover unit 68 comprises a second cap element which is embodied identically to the cap element 34. The second cap element is not shown in the figures.

Figure 5:
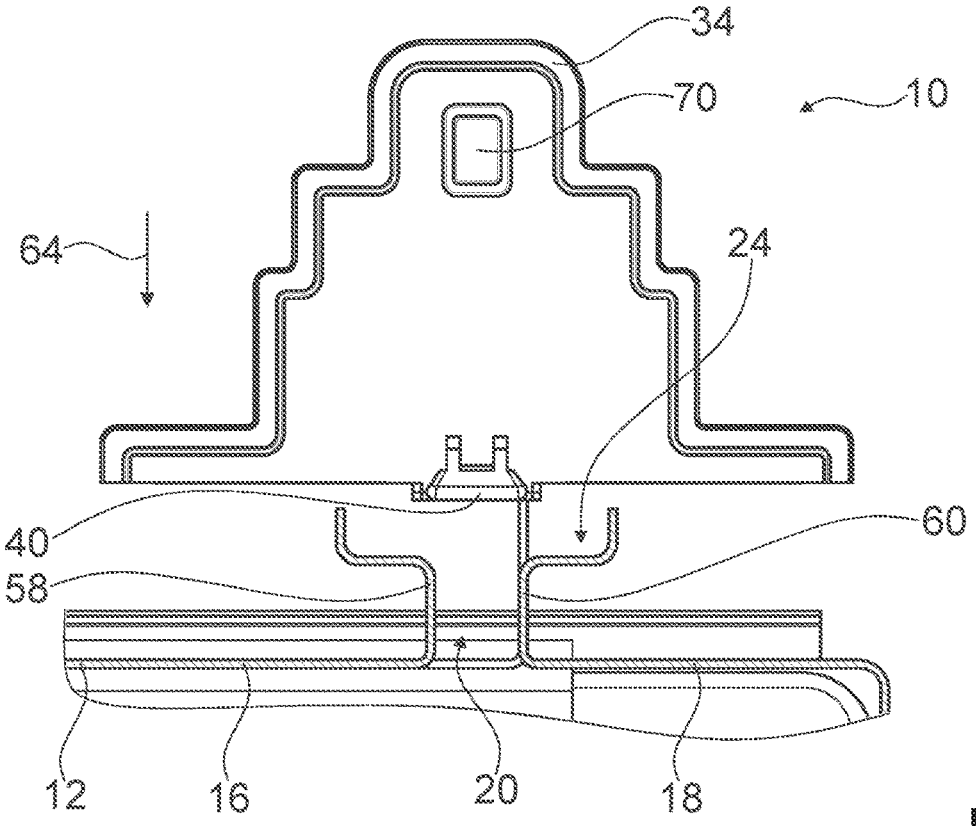
Figure 6:
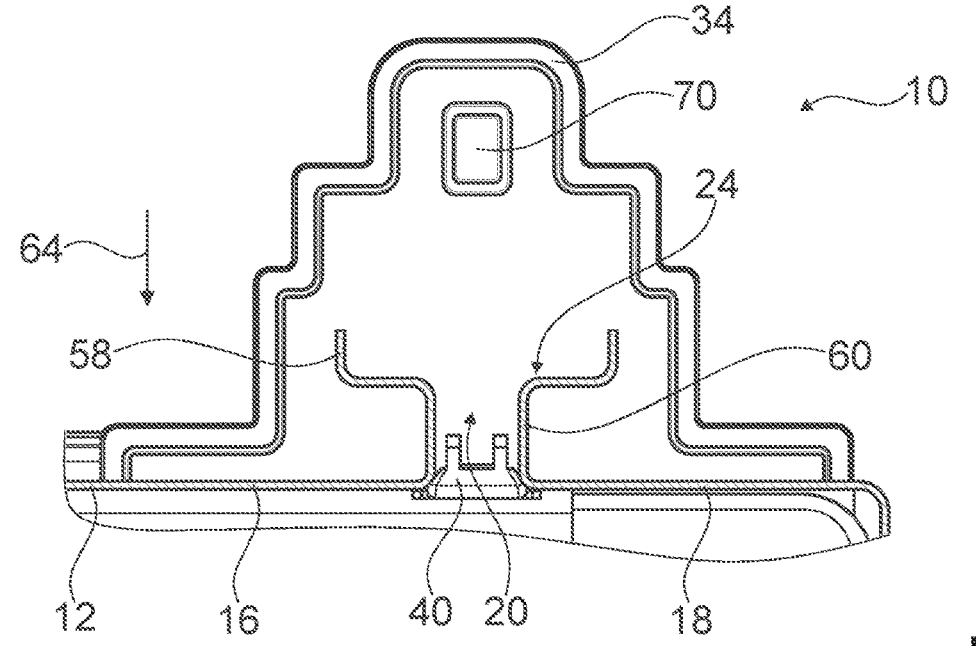

FIG. 5 shows a portion of the home appliance device 10 including the cap element 34 in a pre-mounted state, in a sectional view along the section plane IV of FIG. 2. FIG. 6 shows the portion of the home appliance device 10 including the cap element 34 in a mounted state, in a sectional view along the section plane IV of FIG. 2. For clarity, the cover element 26 is not shown in FIGS. 5 and 6.

The cap element 34 features a latching element 40 for latching to the inner liner 12. During mounting of the cap element 34, the latching element 40 is introduced in the gap 20 in the mounting direction 64 and subsequently latched with the first wall section 16 and with the second wall section 18, in particular with the guiding unit 24. During assembly, the cover element 26 is attached to the inner liner 12 before the cap element 34 is attached to the cover element 26 and to the inner liner 12.

The latching element 40 protrudes at least partly through the gap 20 into the storage space 14.

Figure 7:
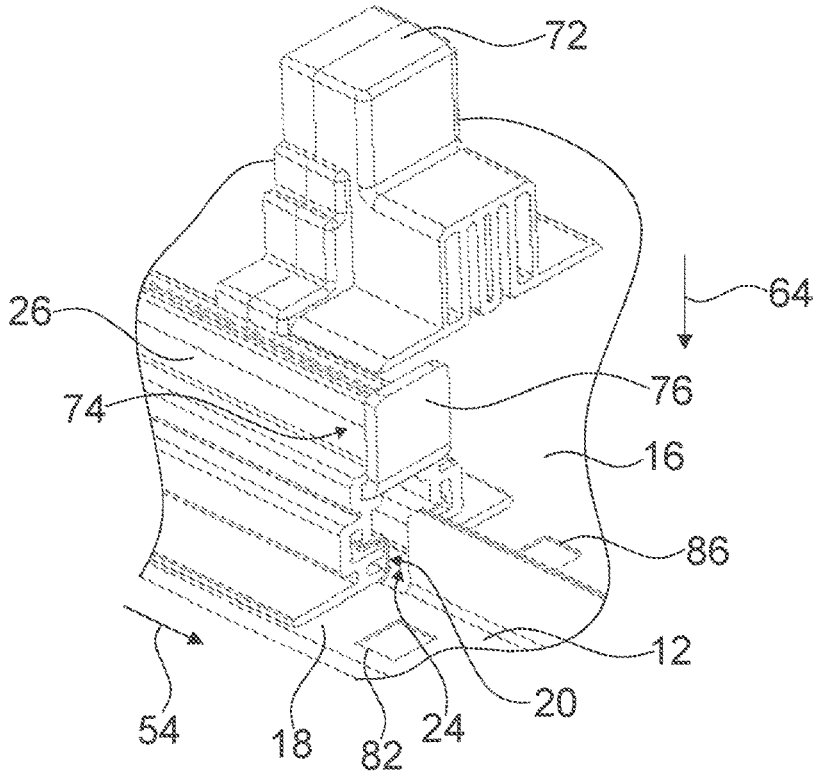
Figure 8:
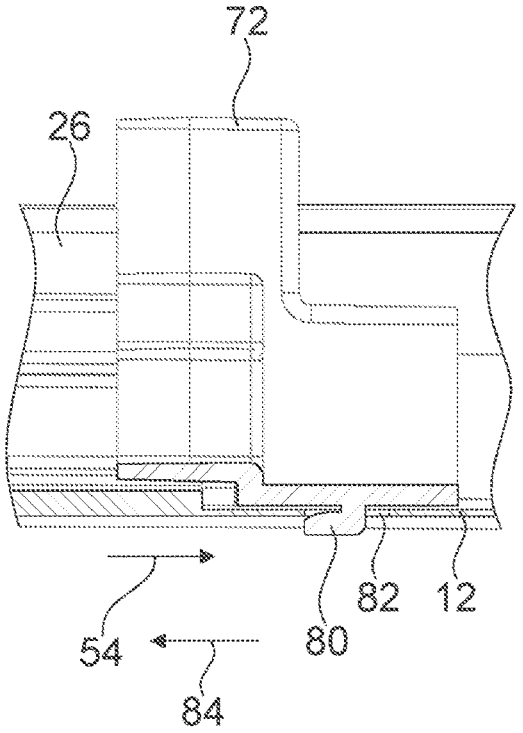
Figure 9:
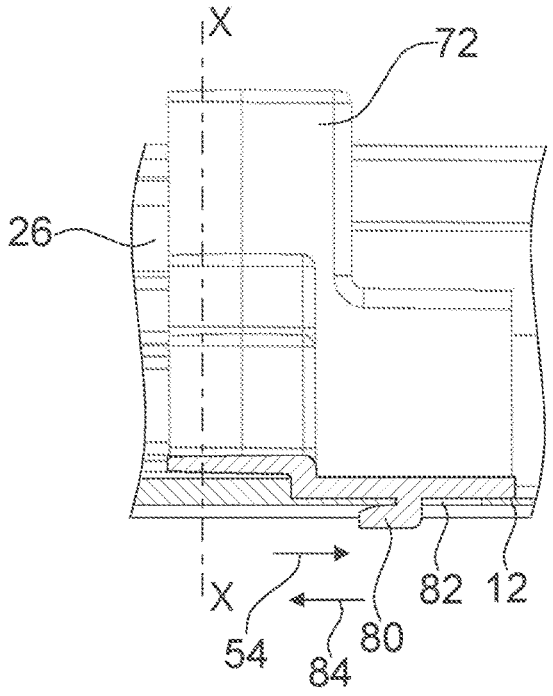
Figure 10:
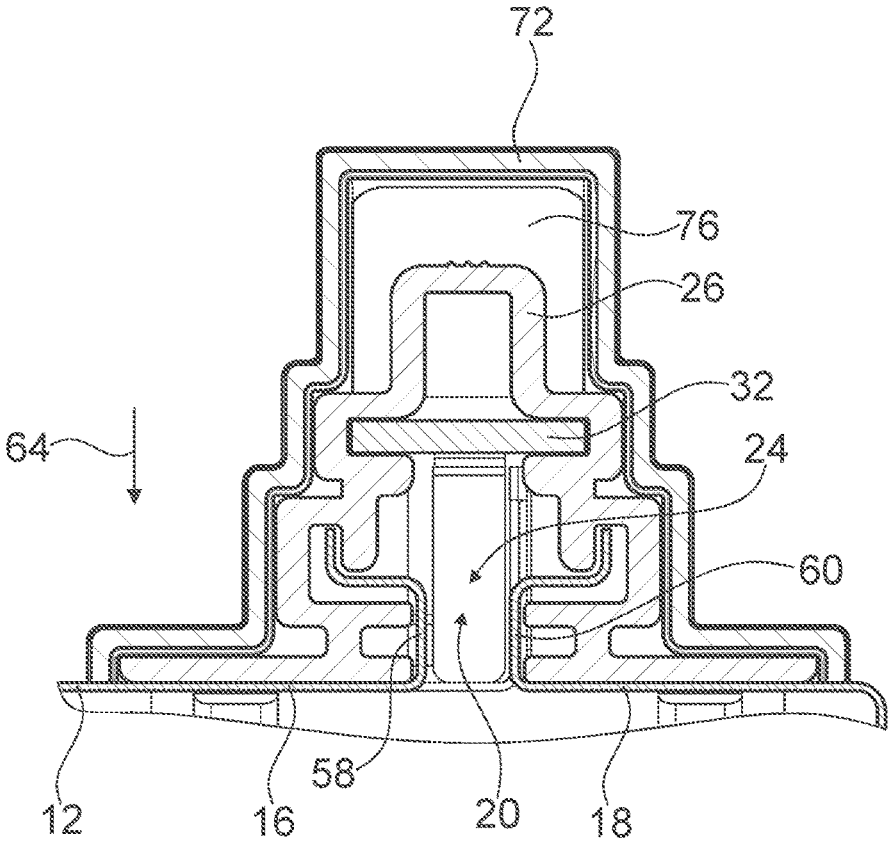

FIG. 7 shows a portion of the home appliance device 10 including an additional cap element 72 of the cover unit 22 in a pre-mounted state, in a perspective view. FIG. 8 shows a portion of the home appliance device 10 including the additional cap element 72 in a pre-mounted state, in a sectional lateral view. FIG. 9 shows the portion of the home appliance device 10 including the additional cap element 72 in a mounted state, in a sectional lateral view. FIG. 10 shows a portion of the home appliance device 10 including the additional cap element 72, in a sectional top view along a section line X-X of FIG. 9.

The additional cap element 72 covers an additional axial end portion 74 of the cover element 26 opposite the axial end portion 36 of the cover element 26. The additional axial end portion 74 is a top end portion of the cover element 26. The additional cap element 72 is implemented analogously to the cap element 34. The following description is substantially limited to the differences between the cap element 34 and the additional cap element 72, wherein regarding structural elements, features and functions that remain the same, the description of the cap element 34 may be referred to. Furthermore, a person having ordinary skill in the art will purposefully also consider combining structural elements, features and functions of the cap element 34 and the additional cap element 72.

The additional cap element 72 covers a top end portion 76 of the supporting element 32. The top end portion 76 of the support element 32 is implemented as a flap. The top end portion 76 of the support element 32 prevents the support element 32 from sliding downwards through the covering element 62.

The additional cap element 72 features a latching element 80 for latching to the inner liner 12. The inner liner 12 features a receiving opening 82. During assembly, the additional cap element 72 is slid over the top end portion 76 in a direction parallel to the mounting direction 64. Thereby, the latching element 80 is introduced in the receiving opening 82. Subsequently, the additional cap element 72 is moved in a direction 84 parallel to the height direction 54 in order to latch the latching element 80 with the receiving opening 82. In the case shown the inner liner 12 features two receiving openings 82, 86. The additional cap element 72 features two latching elements 80, only one of which latching elements 80 is shown in the figures.

The following is a summary list of reference numerals and the corresponding structure used in the above description of the invention:

10 home appliance device
12 inner liner
14 storage space
16 wall section
18 wall section
20 gap
22 cover unit
24 guiding unit
26 cover element
28 cover element longitudinal axis
30 gap longitudinal axis
32 supporting element
34 cap element
36 end portion
38 rear side
40 latching element
42 seam
44 seam cover element
46 end portion
48 seam cover element
50 home appliance
52 outer liner
54 height direction
56 shelf element
58 guiding element
60 guiding element
62 covering element
64 mounting direction
66 gap
68 cover unit
70 protrusion
72 cap element
74 end portion
76 End portion
78 opening
80 latching element
82 receiving opening
84 direction
86 receiving opening
88 bottom side

The invention claimed is:

1. A home appliance device, comprising:

at least one inner liner defining at least one storage space and having at least one first wall section and at least one second wall section with at least one gap between the first wall section and the second wall section; and a separate cover unit which is connected to the inner liner and is arranged outside the storage space, said cover unit covering the gap;

said cover unit including a cover element which has a cover element longitudinal axis oriented at least substantially parallel to a gap longitudinal axis of the gap;

said cover unit including at least one cap element which at least partly covers at least one axial end portion of said cover element; and said inner liner having at least one seam arranged below the gap; and said cap element featuring at least one seam cover element which partly engages around at least one axial end portion of the seam.

2. The home appliance device according to claim 1, the first wall section and the second wall section together forming at least one guiding unit which delimits the gap and is configured for insertion of at least one storage unit support element.

3. The home appliance device according to claim 1, the cover element comprising at least one supporting element for supporting a storage unit support element.

4. The home appliance device according to claim 1, the cap element covering the cover element on at least one rear side which faces away from the storage space.

5. The home appliance device according to claim 1, the cap element being implemented mirror-symmetrically.

6. The home appliance device according to claim 1, the cap element sealing the axial end portion of the cover element during foaming.

7. The home appliance device according to claim 1, the cap element featuring at least one latching element for latching to the inner liner.

8. The home appliance device according to claim 7, the latching element protruding at least partly through the gap into the storage space.

9. The home appliance device according to claim 1, the cap element featuring at least one additional seam cover element, which is implemented mirror-symmetrically to the seam cover element.

10. The home appliance device according to claim 1, the first wall section and/or the second wall section being made of metal.

11. A home appliance, comprising at least one home appliance device according to claim 1.

12. The home appliance according to claim 11 configured as a home chiller appliance.

13. The home appliance device according to claim 1 configured as a home chiller appliance.

14. The home appliance device according to claim 1, further comprising at least one outer liner, the cover unit being arranged inside the outer liner.

15. The home appliance device according to claim 14, wherein the cover unit is arranged between the outer liner and the inner liner.

* * * * *